United States Patent [19]

DeSelms

[11] 4,216,936

[45] Aug. 12, 1980

[54] BACK FOR PICTURE FRAME

[76] Inventor: Dean B. DeSelms, 7001 Pierce, Arvada, Colo. 80003

[21] Appl. No.: 911,838

[22] Filed: Jun. 2, 1978

[51] Int. Cl.[2] ..... A47B 97/04

[52] U.S. Cl. ..... 248/460; 248/DIG. 9; 40/152.1

[58] Field of Search ..... 248/46, 462, 463, 465; 40/152.1, 152

[56] References Cited

U.S. PATENT DOCUMENTS

| | | | |
|---|---|---|---|
| 440,201 | 11/1890 | Servus | 248/460 X |
| 1,820,841 | 8/1931 | Soreff | 248/463 |
| 2,474,532 | 6/1949 | Kitchen | 248/463 X |
| 2,758,402 | 8/1956 | Fulmer | 40/152.1 |
| 3,883,108 | 5/1975 | Swartz | 248/460 |

*Primary Examiner*—Louis G. Mancene
*Assistant Examiner*—Wenceslao J. Contreras
*Attorney, Agent, or Firm*—Shlesinger, Arkwright, Garvey and Dinsmore

[57] ABSTRACT

This invention relates to an easel for supporting a display frame which is adhesively secured to the display frame. The mounting plate of the easel is provided with a series of vertical slots which engage with the tongue of a support arm to angularly support the frame and additionally provided with adhesive material on the back side to allow for attachment to a display frame. The mounting plate is preformed in a channel-like configuration or may alternatively be manufactured as a flat piece and be provided with flexibility producing scoring lines to allow for shaping of the mounting plate into a channel-like configuration. The support arm is additionally provided with stabilizing sway-inhibiting horizontal projections directly adjacent to each of the engaging tongues.

4 Claims, 5 Drawing Figures

BACK FOR PICTURE FRAME

BACKGROUND AND FIELD OF THE INVENTION

The present invention relates to a supporting easel for supporting display frames and particularly for supporting display frames for photographs, paintings and the like.

The use of supporting easels which are attachable to display frames is widespread and well known in the prior art. However, the supporting easels of the prior art do not sufficiently achieve the major objectives of supporting easels such as, easy attachment to a display frame, adaptability to various sizes and types of display frames, adjustabiity to allow for variable positioning both before and after attachment to the display frame, asthetically appealing in design and structure, and availability to the consumer at an inexpensive price.

The Swartz easel, U.S. Pat. No. 3,883,108, discloses a supporting easel which must be attached to a frame by screw secured fasteners and is adjustable to the extent allowed by the two vertical slots contained on the elongated standard attachment to the frame. The Hunter frame support, U.S. Pat. No. 482,978, provides an adhesively attachable support member which is adjustable prior to attachment to the frame.

OBJECTS AND SUMMARY

It is apparent then, that none of the supporting easels for display frames disclosed in the prior art sufficiently achieve the aforementioned major objectives of a supporting easel. It is therefore an objective of the present invention to provide a supporting easel which is readily attachable to display frames.

It is a further objective of the present invention to provide a supporting easel which is readily adaptable for use in supporting display frames of various sizes.

Another object of the present invention is to provide a supporting easel which is readily angularly and vertically adjustable after attachment to a display frame.

Still another object of the present invention is to provide a supporting easel which is asthetically appealing in structure and design.

A further object of the present invention is to provide a supporting easel which is easily and inexpensively manufactured.

Another object of the present invention is to provide a supporting easel which is comprised of a mounting plate and supporting arm which can both be manufactured as flat pieces.

It is a further object of the present invention to provide a supporting easel which is easily disassembled from the display frame to allow for easy storage of the display frame and easel.

These and further objects of the present invention are accomplished by a display frame supporting easel which is comprised of a mounting plate which is self-adhesively attachable to a display frame and a supporting arm which contains two vertically upward extending tongues which adapt the supporting arm for securely engaging with the vertical slots on the mounting plate; thereby, providing a supporting arm against which the display frame is propped. The mounting plate is preformed in a channel-like configuration or may alternatively be manufactured as one flat piece and be provided with flexibility producing scoring lines to allow for shaping of the mounting plate into a channel-like configuration just prior to attachment to a display frame. The support arm of the present invention additionally has at its upper end four horizontal projections directly adjacent to the engaging tongues which stabilize the supported display frame by inhibiting sideward sway of the frame and easel.

DETAILED DESCRIPTION OF THE INVENTION

Figure 3:
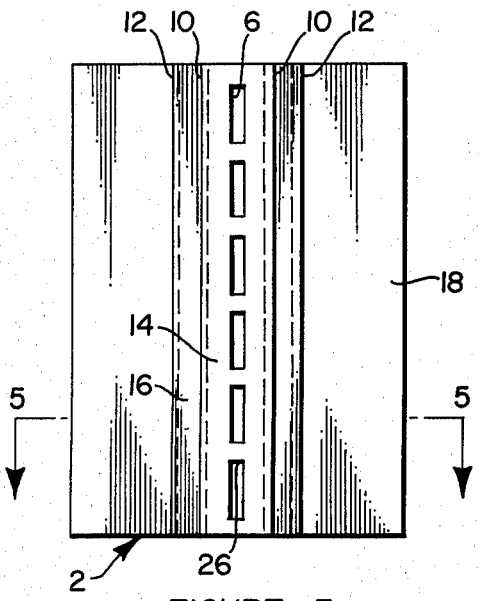
FIG. 3 is a front view of the mounting plate of the present invention.
Figure 4:
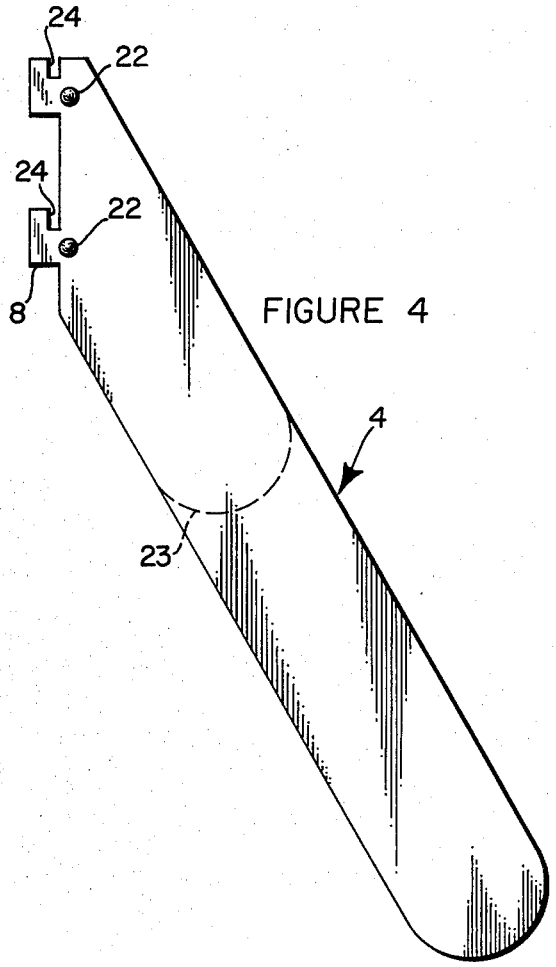
FIG. 4 is a side view of the support arm of the present invention.
Figure 5:
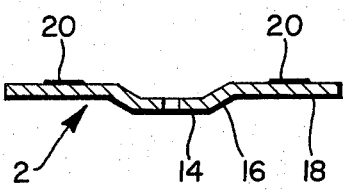
FIG. 5 is a side view of the mounting plate of the present invention formed into shape for attachment to a frame.

Referring now to the drawings, the easel A of the present invention is generally comprised of a mounting plate 2 and a support arm 4. The mounting plate 2 is preformed into a channel-like configuration as that shown in FIGS. 1 and 5. Alternatively, the mounting plate 2 is manufactured as one flat piece, as that shown in FIG. 3, in which case the mounting plate 2 is provided with a series of vertical slots 6 for engagement with the engaging tongues 8 of the support arm 4. The mounting plate 2 is additionally provided with scoring lines 10 and 12 which partially penetrate through the mounting plate 2 and partition the mounting plate into a central portion 14, intermediate side portion 16, and side flange area 18. The scoring lines 10 and 12 provide the mounting plate 2 with the flexibility necessary to allow the mounting plate 2 to be properly shaped just prior to mounting on a display frame and yet still allow the mounting plate to be manufactured as one flat piece. The mounting plate 2, in both the preformed and flat piece configurations, is further provided with adhesive material 20 on the back side of the side flange areas 18; thereby permitting the mounting plate 2 to be self adhesively attached to a display frame F.

Figure 2:
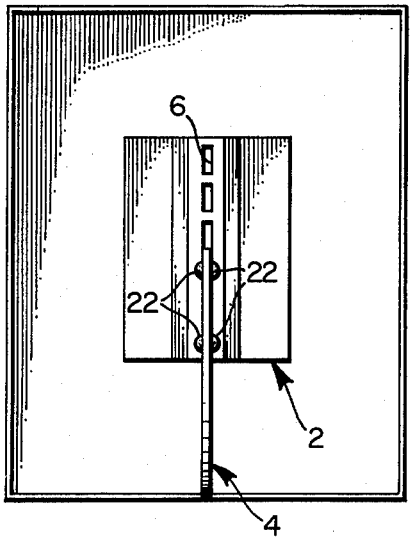
FIG. 2 is a rear view of the invention secured to a display frame.

The support arm 4 is provided at its upper end with two engaging tongues 8 which extend vertically upward and are adapted for locking engagement with two of the vertical slots 6 of the mounting plate 2. The support arm 4 additionally has at its upper end, directly adjacent to the engaging tongues, four horizontal projections 22 which stabilize the easel when attached to a display frame F by inhibiting the sideward sway of the supported frame. The horizontal projections 22 are most advantageously made in a rounded design, as best illustrated in FIG. 2. This rounded design enables the horizontal projections 22 to easily snap fit into place directly against the mounting plate 2 without any danger of breakage of the projections 22, as would be possible if they were of other shapes. Additionally, the placement of the projections with their uppermost edges directly at the boundary of the engaging tongues 8 and the support arm 4 enables the projections to rigidly support the display frame F in position.

The supporting arm 4 may also be manufactured with score line 23 to enable the supporting arm 4 to be broken into a shorter size and thus allow for height adjustment of the supporting easel A.

The supporting easel A of the present invention is generally and most suitably manufactured from lightweight plastic; however, it may be manufactured from any material which allows for proper utilization of the present invention as herein disclosed.

In its use, the easel A of the present invention is adapted to the desired frame F by attaching the preformed mounting plate 2 to a display frame F with the adhesive material 20 and thereby maintain a space between the display frame and the central portion 14 of the mounting plate 2 sufficient to allow for engagement of the engaging tongues 18 of the support arm 4. Alternatively, the easel A is adapted for use by first shaping the flat piece mounting 2 into the proper mounting shape. This shaping is accomplished by applying inward pressure to the mounting plate 2 while grasping the mounting plate 2 at the vertical score lines 12. This inward pressure thus supplied causes the central portion 14 to be forced in an upward direction, the intermediate side portions 16 to be forced in a downward and inward direction and the side flange area 18 to be forced in an inward direction; thereby giving the mounting plate 2 a shape as that shown in FIG. 5. Thus shaped into a channel-like configuration, the mounting plate 2 can be attached to a display frame F by attaching it with the adhesive material 20.

The supporting arm 4 is engaged with the mounting plate 2 by positioning the support arm 4 in a position adjacent to the mounting plate 2, so that, the engaging tongues 8 are directly above two vertical slots 6 and are parallel to the two vertical slots 6. Thus positioned, pressure is applied to the support arm 4 in order to push the engaging tongues 8 through the vertical slots 6 and then to push the engaging tongues 8 in a direction parallel to the vertical slots 6 so as to engage the slotted portions 24 of the engaging tongues 8 with the upper edges 26 of the vertical slots 6; thereby securely locking the supporting arm 4 into position.

Figure 1:
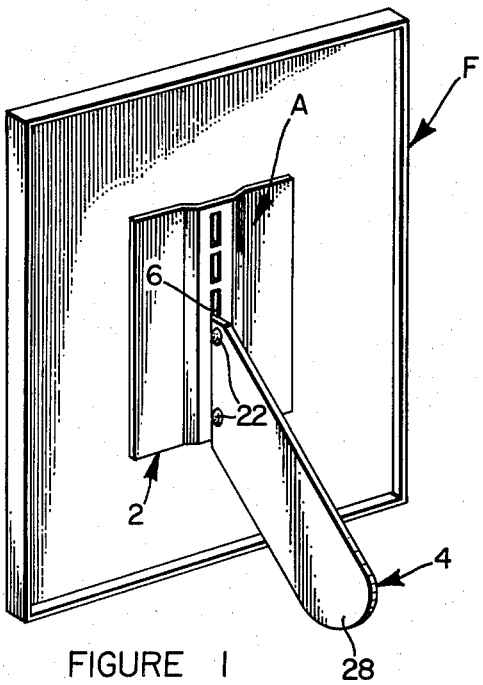
FIG. 1 is a side angle view of the invention secured to the display frame.

Thus attached and engaged, the supporting easel A of the present invention is prepared to support a display frame F, as in FIGS. 1 and 2, with the lower end 28 of support arm 4 resting on a horizontal surface to vertically support the frame and with the horizontal projections 22 stabilizing the display frame by preventing sideward sway of the frame F and supporting easel A.

Angular adjustment of the supported display frame F, after adhesive attachment of the mounting plate 2, is accomplished by transfer of the engaging tongues 8 into a different pair of vertical slots 6 and/or by replacing the support arm 4 with a support arm of a different length.

Transfer of the engaging tongues 8 into a different pair of vertical slots 6 is easily accomplished and thereby allows for quick and easy adjustment of the angle of the display frame F which is not easily accomplished by the supporting easels of the prior art and additionally allows for greater adjustment than available by use of the prior art inventions.

Angular adjustment of the supported display frame F after adhesive attachment of the mounting plate 2, is further accomplished by replacing the supporting arm 4 with a supporting arm of a different length. Typically supporting arms of three and six inches in length are used to enable supporting of display frames ranging in size from 4×5 to 9×12 inches. It is to be understood however, that this invention is not limited to these dimensions and modifications, but rather, is capable of being manufactured in sizes which allow the supporting easel of the present invention to be capable of supporting frames of various sizes.

While this invention has been described as having a preferred design, it will be understood that it is capable of further modification. This application, is, therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. A supporting easel for supporting a picture frame or the like comprising:

(a) a mounting plate having means for attaching said plate to a frame;

(b) said plate having a front and a rear surface, a center section and side sections and a top and bottom;

(c) said center section being offset from said side sections so that said sections form a channel;

(d) said plate having at least three slots in said center section extending from the top to bottom thereof;

(e) a one piece support arm having sides, a base support end and a slot engaging end;

(f) said slot engaging end including a pair of spaced tongues;

(g) said tongues being hook-shaped and opening upwardly;

(h) said tongues being spaced from each other a distance substantially equal to the distance between said slots;

(i) said tongues being in a height and width substantially equal to the height and width of said slots;

(j) said tongues having an engaging portion for engaging said mounting plate including a rear wall;

(k) said engaging portion being in thickness substantially that of said plate so that when said tongues are inserted into said slots, and said mounting plate moved downwardly with respect to said tongues, said engaging portion will engage with said plate in a snug fit relationship;

(l) said center section, relative to said side sections, being offset a distance sufficient to provide clearance for said tongues between said picture frame and said center section;

(m) said support arm being planar, having said base support and said slot engaging end lying in said plane, and of a thickness substantially equal to said plate thickness;

(n) said support arm being angularly positioned with respect to said tongues so that when said arm is positioned in said plate, said arm is inclined downwardly from said rear surface of said plate; and (o) said support arm including at least one stabilizing projection on each side thereof having a forward surface substantially in line with the rear wall of said engaging portion of said tongue whereby, when said support arm is positioned so that said tongues are in said slot in said mounting plate and engaged therewith, said projections will engage with said rear surface of said plate thereby preventing sway of said arm with respect to said plate maintaining said frame in a rigid position.

2. A supporting easel for supporting a picture frame or the like as in claim 1 and wherein:

(a) said support arm has two of said projections on each side of said support arm with said projections on each side being aligned and positioned directly adjacent to each of said tongues.

3. A supporting easel for supporting a picture frame or the like as in claim 1 and wherein:

(a) said projections are of a rounded shape so as to allow for a snap fit against said mounting plate.

4. A supporting easel for supporting a picture frame or the like as in claim 1 and wherein:

(a) said support arm is scored to allow for breaking off of a portion to permit adjustments in height.

* * * * *